US005278020A

United States Patent [19]

Grushkin et al.

[11] Patent Number: 5,278,020

[45] Date of Patent: Jan. 11, 1994

[54] TONER COMPOSITION AND PROCESSES THEREOF

[75] Inventors: Bernard Grushkin, Pittsford, N.Y.; Guerino G. Sacripante, Oakville, Canada

[73] Assignee: Xerox Corporation, Stamford, Conn.

[21] Appl. No.: 936,471

[22] Filed: Aug. 28, 1992

[51] Int. Cl.[5] ..... G03C 5/00

[52] U.S. Cl. ..... 430/137; 430/109; 430/110; 430/111; 430/138

[58] Field of Search ..... 430/109, 110, 111, 137, 430/138

[56] References Cited

U.S. PATENT DOCUMENTS

| | | | |
|---|---|---|---|
| 4,797,339 | 1/1989 | Maruyama et al. | 430/109 |
| 4,876,313 | 10/1989 | Lorah | 525/281 |
| 4,983,488 | 1/1991 | Tan et al. | 430/137 |
| 4,996,127 | 2/1991 | Hasegawa et al. | 430/109 |
| 5,037,716 | 8/1991 | Moffat | 430/109 |
| 5,139,915 | 8/1992 | Moffat et al. | 430/110 |

OTHER PUBLICATIONS

Ricoh RTU Spring '92, *Nippon Carbide '127 Associated Particles.*

*Primary Examiner*—John Kight, III
*Assistant Examiner*—Shelley A. Dodson
*Attorney, Agent, or Firm*—John L. Haack; Eugene O. Palazzo

[57] ABSTRACT

A toner composition and processes for the preparation thereof comprising the steps of: (i) preparing a latex emulsion by agitating in water a mixture of a nonionic surfactant, an anionic surfactant, a first nonpolar olefinic monomer, a second nonpolar diolefinic monomer, a free radical initiator and a chain transfer agent; (ii) polymerizing the latex emulsion mixture by heating from ambient temperature to about 80° C. to form nonpolar olefinic emulsion resin particles of volume average diameter from about 5 nanometers to about 500 nanometers; (iii) diluting the nonpolar olefinic emulsion resin particle mixture with water; (iv) adding to the diluted resin particle mixture a colorant or pigment particles and optionally dispersing the resulting mixture with a homogenizer; (v) adding a cationic surfactant to flocculate the colorant or pigment particles to the surface of the emulsion resin particles; (vi) homogenizing the flocculated mixture at high shear to form statically bound aggregated composite particles with a volume average diameter of less than or equal to about 5 microns; (vii) heating the statically bound aggregate composite particles to form nonpolar toner sized particles; (viii) optionally halogenating the nonpolar toner sized particles to form nonpolar toner sized particles having a halopolymer resin outer surface or encapsulating shell; and (ix) isolating the nonpolar toner sized composite particles.

30 Claims, No Drawings

TONER COMPOSITION AND PROCESSES THEREOF

BACKGROUND OF THE INVENTION

This invention is generally directed to toner and developer compositions, and, more specifically, the present invention is directed to toner compositions and processes for the preparation of toner compositions. In one embodiment, there are provided in accordance with the present invention in situ processes for the preparation of toner compositions with average volume particle sizes equal to, or less than about 10 micrometers in embodiments without resorting to classification. The resulting toners can be selected for known electrophotographic imaging and printing processes, including color processes, and lithography. In an embodiment, the present invention is directed to a process for preparing a toner comprised of composite particles comprised of primary particles comprised of a nonpolar copolymer resin, secondary particles comprised of a pigment, wherein the secondary particles reside substantially on the surface of the primary particles and wherein the composite particles may have chemically modified outer surfaces and an average diameter of about 1 to 10 micrometers. In embodiments, the process of the present invention comprises preparing a latex emulsion by agitating a mixture of nonpolar olefins such as styrene and butadiene in an aqueous medium containing a mixture of nonionic and anionic surfactants, a chain transfer agent and a free radical initiator, and polymerizing the mixture by heating to form nonpolar olefinic resin particles in water comprised of, for example, poly(styrene-butadiene); thereafter adding and dispersing pigment particles with the nonpolar olefinic resin particles and flocculating the mixture by the addition of a cationic surfactant; homogenizing the flocculated mixture to form statically bound resin and pigment particle aggregates of from less than about 5 micrometers; heating and thereby fusing the pigment and resin particle aggregate mixture to form composite nonpolar toner sized particles of from about 3 to about 10 micrometers; optionally, chemically modifying the toner surface with, for example, chlorine gas to transform the olefinic resin present on the outer surface of the composite toner particle to, for example, a chlorinated poly(styrene butadiene) species poly(styrene-butadiene-dichloro butene); and isolating the toner particles by concentrating, washing and drying. The toner and developer compositions of the present invention can be selected for electrophotographic, especially xerographic imaging and printing processes, including color processes.

In reprographic technologies, such as xerographic and ionographic devices, toners with small average volume diameter particle sizes of from about 5 microns to about 20 microns are utilized. Moreover, in some xerographic technologies, such as the high volume Xerox Corporation 5090 TM copier-duplicator, high resolution characteristics and low image noise are highly desired, and can be readily attained utilizing small sized toners with average volume particle of less than 11 microns and preferably less than about 7 microns and with narrow geometric size distribution (GSD) of less than about 1.6, preferably less than about 1.4, and more preferably less than about 1.3. Additionally, in some xerographic systems wherein process color is required such as pictorial color applications, small particle size colored toners of less than 9 microns and preferably less than about 7 microns are highly desired to avoid paper curling. Paper curling is especially observed in pictorial or process color applications wherein three to four layers of toners are transferred and fused onto paper. During the fusing step, moisture is driven off from the paper due to the high fusing temperatures of from about 130 to 160 degrees centigrade applied to the paper from the fuser. Where only one layer of toner is present such as in black or highlight xerographic applications, the amount of moisture driven off during fusing is re-absorbed proportionally by paper and the resulting print remains relatively flat with minimal curl. In pictorial color process applications wherein three to four colored toner layers are present, a thicker toner plastic level present after the fusing step inhibits the paper from sufficiently absorbing the moisture lost during the fusing step, and image paper curling results. Since surface area of particle size is inversely proportional to particle size, it is preferable to use small toner particle sizes of less than 9 microns and preferably less than about 7 microns and with higher pigment loading such that the mass of toner layers deposited onto paper is reduced to obtain the same quality of image and resulting in a thinner plastic toner layer onto paper after fusing, and hence, minimizing or avoiding paper curling. Toners prepared in the instant invention with lower fusing temperatures such as from about 100 to about 140 degrees centigrade help to avoid paper curl. Lower fusing temperatures minimizes the loss of moisture from paper, thereby reducing or eliminating paper curl. Furthermore, in process color applications and especially in pictorial color applications, high gloss is necessary, as well as high projection efficiency properties with transparency images.

Numerous processes are known for the preparation of toners, such as, for example, conventional processes wherein a resin is melt kneaded or extruded with a pigment, micronized and pulverized to provide toner particles with an average volume particle diameter of from about 7 microns to about 20 microns and with broad geometric size distribution of from about 1.4 to about 1.7. In such processes it is usually necessary to subject the aforementioned toners to a classification procedure such that the geometric size distribution of from about 1.2 to about 1.6 are attained. However, in the aforementioned conventional process, low toner yields after classifications may be obtained and dependent on the average volume particle sizes of said toner. Generally, during the preparation of toners with average particle size diameters of from about 11 microns to about 15 microns, toner yields range from about 70 percent to about 85 percent after classification. Additionally, during the preparation of smaller sized toners with particle sizes of from about 7 microns to about 11 microns, lower toner yields are obtained after classification, such as from about 50 percent to about 70 percent. With the processes of the present invention in embodiments, small average particle sizes of from about 3 microns to about 9, and preferably 7 microns are attained without resorting to classification processes, and wherein high toner yields are attained such as from about 90 percent to about 98 percent in embodiments. Additionally, toners prepared by conventional processes must not readily aggregate or block during manufacturing, transport or storage prior to use in electrophotographic systems and must exhibit low temperature fusing properties in order to minimize fuser energy requirements. Accordingly, conventional toner resins are restricted to having exhibit glass transition temperatures of greater than about 55 degrees centigrade and preferably of about 60 degrees centigrade to satify caking or blocking requirements. Toner caking or blocking is known in the art and refers to the minimum temperature necessary for toner aggregation to occur over an extended period of time, such as from about 24 hours to 48 hours. The caking or blocking temperature requirement of a toner should be greater than about 55 degrees centigrade and preferably greater than about 60 degrees centigrade, in order to avoid toner aggregation in storage or use prior to fixing a powdered toner image to a receiver sheet. This blocking requirement restricts the toner fusing properties of from about 135 degrees centigrade to about 160 degrees centigrade. In process color or pictorial applications, wherein low paper curl is a requirement, low toner fusing properties are desired such as less than about 140 degrees centigrade and preferably less than 110 degrees centigrade such that moisture evaporation or removal from paper is minimized or preferably avoided. With the toners of this invention, the toners fuse at lower temperatures than conventional toners, such as from about 110 to about 150 degrees centigrade, thereby reducing the energy requirements of the fuser and more importantly resulting in lower moisture driven off from the paper during fusing, and hence lowering or minimizing paper curling. For the toners of this invention, the blocking and fusing properties of the toners are disintegrated by the chemical surface process of halogenating the toner surface. During the process for the preparation of the toner of this invention, the polymerized primary emulsion resin such as poly (styrene-butadiene) exhibits a glass transition temperature of from about 40 degrees centigrade to about 50 degrees centigrade and thermal properties amenable to achieve the low fusing properties such as from about 110 degrees centigrade to about 140 degrees centigrade, and after a flocculation and aggregation fusing process and during, for example, the chlorination step, the outer surface of the toner resin surface is chemically transformed from poly(styrene-butadiene) to chlorinated poly(styrene-butadiene) such that the outer surface of the toner resin composite has a glass transition of from about 55 degrees centigrade to about 60 degrees centigrade necessary for the blocking requirement. This latter chemical surface treatment step allows one to separate toner blocking requirements from fusing requirements and results in low fusing toners of from about 110 degrees centigrade to about 140 degrees centigrade which are necessary to minimize or eliminate paper curling. That is by lowering the fusing temperature range to about 100° to 140° C. a reduction or elimination in paper curl is achieved. In addition, by the toner particle preparation process of this invention, small particle size toners of from about 3 microns to about 7 microns are prepared with high yields as from about 90 percent to about 98 percent by weight of all toner starting material ingredients.

Additionally, other processes such as and including encapsulation, coagulation, coalescence, suspension polymerization, or semi-suspension and the like, are known, wherein the toners are obtained by in situ one pot methods. Moreover, encapsulated toners are known wherein a core comprised of pigment and resin is encapsulated by a shell, and wherein the toner melt rheological properties are separated wherein a core material provides low fusing properties such as from about 100 to 125 degrees centigrade, and an encapsulating shell provides necessary blocking properties for particle stability prior to fusing. However, it is known that encapsulated toners do not provide high gloss due to high surface tension, high glass transition and high melting temperatures of the shell, and also result in poor projection efficiency due to the difference in refractive index between the shell and core resulting in light scattering. Other in situ toners prepared by suspension, coagulation, coalescence, are known, wherein the toners are comprised of substantially similar composition to conventional toners with, in some cases, having surfactants or surface additives on the toner surface prepared by various processes. Although, these latter aforementioned toners are amenable to high gloss, high projection efficiency, and small particle size toners, their fusing performances are restricted to the thermal properties of the toner, such as glass transition (Tg), in that the toners must satisfy blocking requirements and hence are restricted to glass transitions of above 55 degrees centigrade and therefore fusing temperatures of from about 135 to about 160 degrees centigrade, and have inferior paper curl properties for process color applications. By the processes of the instant invention, toner melt rheological properties are separated in that a chemical halogenation process increases the glass transition of the outer surface of the toner composite resin of from about 45 to 55 degrees centigrade to about 55 to 60 degrees centigrade, hence providing required blocking properties and low fusing temperatures of from about 110 degrees centigrade to about 140 degrees centigrade necessary for minimizing or avoiding paper curling.

In the embodiments of the instant invention a process for the preparation of a nonpolar composite particle toner composition is disclosed comprising the steps of: (i) preparing a latex emulsion by agitating in water a mixture of nonionic surfactant such as polyethylene glycol or polyoxyethylene glycol nonyl phenyl ether, an anionic surfactant such as sodium dodecyl sulfonate or sodium dodecyl benzenesulfonate, a first nonpolar olefinic monomer such as styrene, acrylate or methacrylate, a second nonionic nonpolar diolefinic monomer such as butadiene or isoprene; (ii) polymerizing the reaction mixture by heating from ambient temperature to about 80° C. the olefinic and diolefinic monomers to nonpolar olefinic emulsion sized particles of from about 5 nanometers to about 500 nanometers in average volume diameter; (iii) diluting the nonpolar olefinic emulsion resin mixture with water from about 50% solids to about 15% solids; (iv) adding to the mixture a colorant or pigment particles of from about 3 percent to about 15 percent by weight of toner and optionally dispersing the resulting mixture by dispersing utilizing a Brinkman or IKA homogenizer; (v) adding a cationic surfactant such as dialkylbenzene dialkylammonium chloride and the like thereby effecting flocculation of the colorant or pigment particles with emulsion resin particles; (vi) homogenizing the flocculated resin-pigment mixture at from about 2000 to about 6000 revolution per minute to form high shear statically bound aggregate composite particles of less than about 5 microns in volume average diameter; (vii) heating the statically bound aggregate composite particles of from about 60 degrees centigrade to about 95 degrees centigrade and for a duration of about 60 minutes to about 600 minutes to form nonpolar toner sized particles of from about 3 microns to about 9 microns in volume average diameter; (viii) optionally halogenating the nonpolar toner sized particles with a halogen, for example, chlorine gas to chemically transform the nonpolar olefinic moieties of the resin present on the outer surface of the toner resin to chlorine containing hydrocarbon moieties; and (ix) isolating the nonpolar toner sized composite particles by washing, filtering and drying thereby providing a nonpolar composite particle toner composition. Flow additives to improve flow characteristics may then optionally be employed such as Aerosils or silicas, and the like, of from about 0.1 to about 10 percent by weight of the toner.

In a patentability search there is illustrated in U.S. Pat. No. 4,996,127 a toner of associated particles of secondary particles comprising primary particles of a polymer having acidic or basic polar groups and a coloring agent. The polymers selected for the toners of the '127 patent can be prepared by an emulsion polymerization method, see, for example, columns 4 and 5. In column 7 of the '127 patent it is indicated that the toner can be prepared by mixing the required amount of coloring agent and optional charge additive with an emulsion of the polymer having an acidic or basic polar group obtained by emulsion polymerization as indicated in column 3. Additionally, note column 9, line 50 to 55, wherein polar monomers such as acrylic acid in the emulsion resin is necessary, and note Comparative Example 1, column 9, lines 50 to 55 wherein toner preparation is not obtained without the use of a polar group such as acrylic acid. The present invention is directed to an improved process wherein the emulsion monomers or resultant resin particles do not contain acidic or basic groups, and toner particles are obtained without the use of polar acidic groups such as acrylic acid, thereby reducing toner humidity sensitivity. Additionally, with processes of the instant invention, halogenation, for example, chlorination of the outer surface of the composite particles provides an improvement in blocking characteristics, and hence enhances the minimum fix temperature of the toner.

Illustrated in U.S. Pat. No. 4,797,339, is a toner composition comprised of an inner layer comprising a resin ion complex having a coloring agent, a charge enhancing additive and pigment dispersed therein, and an outer layer containing a flowability imparting agent. Note column 2 and 3, wherein the ion complex resin is comprised of an acidic emulsion copolymer resin and basic emulsion resin comprised of styrene acrylates containing acidic or basic polar groups similar to the '127 patent.

U.S. Pat. No. 4,983,488 discloses a process for the preparation of toners by the polymerization of a polymerizable monomer dispersed by emulsification in the presence of a colorant and/or a magnetic powder to prepare a principal resin component and then effecting coagulation of the resulting polymerization liquid in such a manner that the particles in the liquid after coagulation have diameters suitable for a toner. It is indicated in column 9 of this patent that coagulated particles of 1 to 100 micrometers in diameter, and particularly 3 to 70 micrometers in diameter, are obtained. It is also indicated in column 4, lines 60 to 65, that the glass transition of the emulsion resin should be above 50 degrees centigrade, and when the glass transition is too low, caking resistance, that is resistance to blocking, tends to decrease and if the glass transition is too high the fixing property tends to be poor. The toners of the instant invention differ from the reference toners in that the process is simple and does not utilize coagulating agents. Moreover, emulsion resins with relatively lower glass transition of about 40 to 45 degrees centigrade are used, and resistance to caking is avoided by the halogenation process of the toner surface wherein the glass transition is raised to about 50 to about 55 degrees centigrade, hence caking, blocking or undesired aggregation of toner particles is avoided and low fixing temperatures are maintained as well as excellent triboelectric characteristics, high gloss, and low humidity sensitivity.

Copending application U.S. Ser. No. 07/767,454, filed Sep. 30, 1991, the disclosure of which is totally incorporated herein by reference, discloses an in situ suspension process for a toner comprised of a core comprised of a resin, pigment and optionally charge control agent and coated thereover with a cellulosic material. Another patent of interest is copending U.S. Ser. No. 07/695,880, filed May 6, 1991 entitled 'Toner Compositions', the disclosure of which is totally incorporated herein by reference, discloses low melt toner particles prepared by conventional comminution processes that are halogenated to form encapsulated toner particles with a higher melting halopolymer shell.

Additionally, U.S. Pat. No. 4,876,313, discloses an improved core and shell polymers having an alkali-insoluble core and an alkali-soluble shell which polymers are prepared by emulsion polymerization of the core-shell polymers utilizing compounds which chemically graft the core and shell polymers together.

Documents disclosing toner compositions with charge control additives include U.S. Pat. Nos. 3,944,493; 4,007,293; 4,079,014; 4,394,430; and 4,560,635 which illustrates a toner with a distearyl dimethyl ammonium methyl sulfate charge additive. These toners are prepared, for example, by the usual known jetting, micronization, and classification processes. Toners obtained with these processes generally possess a toner volume average diameter of form between about 10 to about 20 microns and are obtained in yields of from about 85 percent to about 98 percent by weight of starting materials without classification procedure.

There is a need for black or colored toners wherein small particle sizes of less than or equal to 7 microns in volume diameter. Furthermore, there is a need for colored toner processes wherein the toner synthetic yields are high, such as from about 90 percent to about 100 percent while avoiding or without resorting to classification procedures. In addition, there is also a need for black and colored toners that are non-blocking, such as from about 55 to about 60 degrees centigrade, of excellent image resolution, non-smearing and of excellent triboelectric charging characteristics. Moreover, there is a need for black or colored toners with: low fusing temperatures, of from about 110 degrees centigrade to about 150 degrees centigrade; of high gloss properties such as from about 50 gloss units to about 85 gloss units; of high projection efficiency, such as from about 75 percent to about 95 percent efficiency or more, and result in minimal or no paper curl.

SUMMARY OF THE INVENTION

It is an object of the present invention to provide toner with many of the advantages illustrated herein.

In another object of the present invention there are provided emulsion aggregation processes for the preparation of composite nonpolar toner particle compositions wherein micronizing, jetting, and classification can in embodiments be avoided.

In yet another object of the present invention there are provided toner compositions with small particle size of, for example, from about 1 to about 7 microns in average volume diameter.

In another object of the present invention there are provided composite nonpolar toner compositions of high yields of from about 90 percent to about 100 percent by weight of toner and without resorting to classification.

In yet another object of the present invention there are provided toner compositions with low fusing temperature of from about 110 degrees centigrade to about 150 degrees centigrade and of excellent blocking characteristics of more than about 55 degrees centigrade to about 60 degrees centigrade.

Another object of the present invention there are provided toner compositions with high gloss such as from about 45 gloss units to about 85 gloss units.

Moreover, in another object of the present invention there are provided toner compositions with high projection efficiency such as from about 75 to about 95 percent efficiency.

It is a further object of the present invention there are provided toner compositions which result in low paper curl.

Another object of the present invention resides in providing emulsion aggregation processes for composite nonpolar toner compositions by coalescing or fusing statically bound aggregates comprised of primary nonpolar resin emulsion particles and pigment particles and wherein the resulting toner composites possess an volume average diameter of from between about 3 to 15, and preferably from between about 3 to about 7 microns.

Also, in another object of the present invention there are provided developer compositions with composite nonpolar toner particles obtained by the processes illustrated herein, carrier particles, and optional enhancing additives or mixtures of these additives.

Another object of the present invention resides in the formation of toners which will enable the development of images in electrophotographic imaging apparatuses, which images have substantially no background deposits thereon, and are of excellent resolution; and further, such toner compositions can be selected for high speed electrophotographic apparatuses, that is those exceeding 70 copies per minute.

In embodiments, the present invention is directed to processes for the preparation of composite nonpolar toner compositions comprised, for example, of primary nonpolar resin particles, secondary pigment particles, and optional charge enhancing additives comprised of, for example, chromium salicylates, quaternary ammonium hydrogen bisulfates, tetraalkyl ammonium sulfonate, and the like. More specifically, the present invention in one embodiment is directed to emulsion aggregation processes for the preparation of nonpolar composite particle toner composition comprising the steps of: (i) preparing a latex emulsion by agitating in water a mixture of nonionic surfactant such as polyethylene glycol or polyoxyethylene glycol nonyl phenyl ether, an anionic surfactant such as sodium dodecyl sulfonate or sodium dodecyl benzenesulfonate, a first nonpolar olefinic monomer such as styrene, acrylate or methacrylate, a second nonpolar diolefinic monomer such as butadiene or isoprene; (ii) polymerizing the reaction mixture by heating from ambient temperature to about 80° C. the olefinic and diolefinic monomers to form nonpolar olefinic copolymer resin particles sized from about 5 nanometers to about 500 nanometers in volume average diameter; (iii) diluting the nonpolar olefinic emulsion copolymer resin mixture with water from about 50% solids to about 15% solids; (iv) and adding to the mixture colorant or pigment particles of from about 3 percent to about 15 percent by weight of toner and optionally dispersing the mixture by dispersing utilizing a Brinkman or IKA homogenizer; (v) thereafter adding a cationic surfactant such as dialkylbenzene dialkylammonium chloride and the like thereby effecting flocculation of the colorant or pigment particles with emulsion resin; (vi) homogenizing the flocculated mixture at from about 2,000 to about 6,000 revolution per minute to form statically bound aggregate composite particles of less than about 5 microns in volume average diameter; (vii) heating the statically bound aggregate composite particles of from about 60 degrees centigrade to about 95 degrees centigrade and for a duration of about 60 minutes to about 600 minutes to form nonpolar toner sized particles of from about 3 microns to about 9 microns in volume average diameter; (viii) halogenating the nonpolar toner sized particles with for example chlorine gas to chemically transform the nonpolar olefinic moieties of the resin present on the outer surface of the toner composite to chlorine moieties; and (ix) isolating the nonpolar toner sized particles by washing, filtering and drying thereby providing a nonpolar composite particle toner composition. Flow additives to improve flow characteristics and charge additives to improve charging characteristics may then optionally be employed such as Aerosils or silicas, and the like, of from about 0.1 to about 10 percent by weight of the toner.

Illustrative examples of the nonionic monomers useful in the instant invention, include a number of known components such as olefins including, acrylates, methacrylates, styrene and its derivatives such as methyl acrylate, ethylacrylate, propyl acrylate, butyl acrylate, hexyl acrylate, methyl methacrylate, ethyl methacrylate, propyl methacrylate, butyl methacrylate, hexyl methacrylate, methyl styrene, and the like. Specific examples of nonionic monomers include styrene, alkyl substituted styrenes, halogenated styrenes, halogenated alkyl substituted styrenes and the like.

Illustrative examples of the nonionic diolefinic or diene monomers useful in the instant invention, include a number of known components as butadiene, substituted butadienes, for example, methyl butadiene, isoprene, mycerine, alkyl substituted isoprene, mixtures thereof and the like.

The copolymer resins formed from the above mentioned monomers are generally present in the toner composition in various effective amounts depending, for example, on the amount of the other components, and providing many of the objectives of the present invention are achievable. Generally, from about 70 to about 95 percent by weight of the copolymer resin is present in the toner composition, and preferably from about 75 to about 90 percent by weight. The proportion of the two monomers in the copolymer resin is from about 50 to about 95 weight percent of olefin and from about 5 to about 50 weight percent of diolefin or diene.

Typical examples of specific colorants, preferably present in an effective amount of, for example, from about 3 to about 10 weight percent of toner include Paliogen Violet 5100 and 5890 (BASF), Normandy Magenta RD-2400 (Paul Uhlich), Permanent Violet VT2645 (Paul Uhlich), Heliogen Green L8730 (BASF), Argyle Green XP-111-S (Paul Uhlich), Brilliant Green Toner GR 0991 (Paul Uhlich), Lithol Scarlet D3700 (BASF), Toluidine Red (Aldrich), Scarlet for Thermoplast NSD Red (Aldrich), Lithol Rubine Toner (Paul Uhlich), Lithol Scarlet 4440, NBD 3700 (BASF), Bon Red C (Dominion Color), Royal Brilliant Red RD-8192 (Paul Uhlich), Oracet Pink RF (Ciba Geigy), Paliogen Red 3340 and 3871K (BASF), Lithol Fast Scarlet L4300 (BASF), Heliogen Blue D6840, D7080, K7090, K6910 and L7020 (BASF), Sudan Blue OS (BASF), Neopen Blue FF4012 (BASF), PV Fast Blue B2G01 (American Hoechst), Irgalite Blue BCA (Ciba Geigy), Paliogen Blue 6470 (BASF), Sudan II, III and IV (Matheson, Coleman, Bell), Sudan Orange (Aldrich), Sudan Orange 220 (BASF), Paliogen Orange 3040 (BASF), Ortho Orange OR 2673 (Paul Uhlich), Paliogen Yellow 152 and 1560 (BASF), Lithol Fast Yellow 0991K (BASF), Paliotol Yellow 1840 (BASF), Novaperm Yellow FGL (Hoechst), Permanent Yellow YE 0305 (Paul Uhlich), Lumogen Yellow D0790 (BASF), Suco-Gelb L1250 (BASF), Suco-Yellow D1355 (BASF), Sico Fast Yellow D1165, D1355 and D1351 (BASF), Hostaperm Pink E (Hoechst), Fanal Pink D4830 (BASF), Cinquasia Magenta (DuPont), Paliogen Black L0084 (BASF), Pigment Black K801 (BASF) and carbon blacks such as REGAL 330? (Cabot), Carbon Black 5250 and 5750 (Columbian Chemicals), and the like.

Surfactants utilized are known and include, for example, nonionics surfactant such as polyvinyl alcohol, polyacrylic acid, methalose, methyl cellulose, ethyl cellulose, propyl cellulose, hydroxy ethyl cellulose, carboxy methylcellulose, polyoxyethylene cetyl ether, polyoxyethylene lauryl ether, polyoxyethylene octyl ether, polyoxyethylene octyphenyl ether, polyoxyethylene oleyl ether, polyoxyethylene sorbitan monolaurate, polyoxyethylene stearyl ether, polyoxyethylene nonylphenyl ether (available from GAF as Igepal CA-210, Igepal CA-520, Igepal CA-720, Igepal CO-890, Igepal CO-720, Igepal CO-290, Igepal CA-210, Antarax 890 and Antarax 897 available from Phone-Poulenc, dialkylphenoxy poly(ethyleneoxy)ethanol and the like. An effective concentration of the nonionic surfactant generally employed is, for example, from about 0.01 to about 10 percent by weight, and preferably from about 0.1 to about 5 percent by weight of monomers used to prepare the copolymer resin.

Examples of anionic surfactants selected for the preparation of toners and processes of the present invention are, for example, sodium dodecylsulfate (SDS), sodium dodecyl-benzenesulfate, sodium dodecylnaphthalenesulfate, dialkyl benzenealkyl, sulfates and sulfonates and the like. An effective concentration of the anionic surfactant generally employed is, for example, from about 0.01 to about 10 percent by weight, and preferably from about 0.1 to about 5 percent by weight of monomers used to prepare the copolymer resin.

Examples of the cationic surfactants selected for the toners and processes of the present invention are, for example, dialkyl benzenealkyl ammonium chloride, lauryl trimethyl ammonium chloride, alkylbenzyl methyl ammonium chloride, halide salts of quaternized polyoxyethylalkylamines, dodecylbenzyl triethyl ammonium chloride, MIRAPOL TM and ALKAQUAT TM available from Alkaril Chemical Company, SANIZOL TM, available from Kao Chemicals, and the like and mixtures thereof. An effective concentration of the cationic surfactant generally employed is, for example, from about 0.01 to about 10 percent by weight and preferably from about 0.1 to about 5 percent by weight of monomers used to prepare the copolymer resin.

An effective concentration of a chain transfer agent that is generally employed is, for example, from about 0.005 to about 0.5 percent by weight, and preferably from about 0.01 to about 0.10 percent by weight of monomers, of for example, dodecanethiol, carbon tetrabromide and the like.

Illustrative examples of known free radical initiators that can be selected for the preparation of the toners include azo-type initiators such as 2-2'-azobis(dimethylvaleronitrile), azobis(isobutyronitrile), azobis(cyclohexane-nitrile), azobis(methyl-butyronitrile), mixtures thereof, and the like, peroxide initiators such as benzoyl peroxide, lauroyl peroxide, methyl ethyl ketone peroxide, isopropyl peroxy-carbonate, 2,5-dimethyl-2,5-bis(2-ethylhexanoyl-peroxy)hexane, di-tert-butyl peroxide, cumene hydroperoxide, dichlorobenzoyl peroxide, potassium persulfate, ammonium persulfate, sodium bisulfite, combination of potassium persulfate and sodium bisulfite, mixtures thereof, with the effective quantity of initiator being, for example, from about 0.1 percent to about 10 pervent by weight of that of core monomer.

The aforementioned toner sized particles obtained from heating the statically bound aggregate composite particles of step (vii) of the toner process are optionally surface halogenated, partially or exhaustively, for example 100 percent, to convert olefinic double bonds by an electrophilic addition reaction in the surface polymer chain backbone and pendant groups into the corresponding halogenated hydrocarbon functionality. In many instances, surface halogenation of toner particles affords further control of the variety of rheological properties that may be obtained from the copolymer resins. Surface halogenation is accomplished with a gaseous mixture or liquid solution of an effective amount of from 0.01 to about 5 double bond molar equivalents of halogen gas or halogen liquid dissolved in water, or an organic solvent, for example, chlorine gas, liquid bromine, or crystalline iodine dissolved in a solvent, such as an aliphatic alcohol, like ethanol which does not dissolve or substantially alter the size or shape of the toner particles.

When more reactive halogens such as fluorine ($F_2$) are used, an inert carrier gas, such as argon or nitrogen, may be selected as a diluent, for example, from about 0.1 to about 98 percent by volume of the inert gas relative to the reactive halogen gas, to moderate the extent of reaction, and the temperature and control corrosivity of the halogenation-encapsulation process.

A number of equally useful halogenating agents are known that afford equivalent reaction products with olefinic double bonds as the aforementioned diatomic halogens, for example as disclosed by House in "Modern Synthetic Reactions", W. A. Benjamin, Inc., 2nd Ed., Chapter 8, page 422, and references cited therein, the disclosure of which is incorporated in its entirety by reference.

The aggregate composite particles obtained from the heating step are subjected to optional halogenation, especially chlorination, by, for example, admixing the toner with an aqueous solution of the halogen. Halogens include chlorine, bromine, iodine, and fluorine, with chlorine being preferred. With fluorine, an aqueous solution is not utilized, rather there is selected fluorine with an inert atmosphere. Although it is not desired to be limited by theory, it is believed that the halogen, especially the chlorine, adds across the double bonds of the toner resin particles to form carbon-halogen bonds. The aforementioned halogenation can be considered an addition reaction, that is, for example, the halogen reacts with, and diffuses into the toner resin, whereby a shell thereof is formed. The shell can be of various effective thicknesses; generally, however, the shell is of a thickness of from about 1 micron or less, and more specifically from about 0.1 to about 1 micron, in embodiments. Typical amounts of halogen consumed include, for example, from about 0.1 to about 1 gram of halogen per 100 grams of toner polymer resin. In an embodiment, the composite particles are admixed with a solution of water and chlorine, which solution has a pH of from about 2.0 to about 3.0, and preferably about 2.5. Specifically, about 150 grams of composite particles can be added in 300 milliliters of an alcohol, such as ethanol, to about 7.5 liters of a chlorine solution at a pH of between about 2.5 and about 3.0, resulting in a pH thereof of from about 2.6 to about 3.2 after about 20 minutes. Generally, from about 100 grams to about 200 grams of toner are admixed with from about 5 to about 10 liters of halogen solution, especially chlorine solution, which solution is comprised of water and halogen, it being noted that a fluorine solution is usually not selected as indicated herein. A sufficient amount of nonpolar composite particles and halogen solution are admixed to enable the formation of an effective shell.

The following examples are provided to further define various species of the present invention. These examples are intended to be illustrative only and are not intended to limit the scope of the present invention.

EXAMPLE I

A 9 micron in situ toner comprised of Hostaperm TM Pink E-21 pigment, poly(styrene butadiene) and outer resin surface of chlorinated poly(styrene butadiene).

A one liter stainless steel PARR TM reactor was charged with 400 grams of water, 88 grams of styrene, 4 grams of dodecanethiol, 2 grams of polyoxyethylene nonyl phenyl ether (Antarax 897, available from Rhone-Poulenc), 2 grams of sodium dodecylsulfate and 1.5 grams of potassium persulfate. Next was added 27 grams liquid butadiene at 5 degrees centigrade and the mixture pressurized to about 40 pounds per square inch with nitrogen gas. The mixture was then heated to 80 degrees centigrade for 6 hours, followed by cooling to room temperature to yield a latex comprised of about 40 percent by weight of solids comprised of nonpolar poly(styrene-butadiene) emulsion resin. A portion of this nonpolar olefinic emulsion resin was then washed, dried and characterized to display a glass transition temperature of about 45 degrees centigrade, and a number average molecular weight of 16,000 by Gel Permeation Chromatography (GPC) utilizing polystyrene standards. A one liter kettle was then charged with 200 grams of the aforementioned latex, 40 percent solids of poly(styrene-butadiene), 8 grams of a wet cake of Hostaperm TM Pink E-21 (50 percent solids in water) and the mixture homogenized using a Brinkman probe for 10 minutes at 4000 revolutions per minute. To this dispersion, was then added 1 gram dialkyl benzene alkyl ammonium chloride (Alkaquat TM, available from Alkaril Chemical Limited) resulting in flocculation of pigment and nonpolar emulsion particles. The flocculated material was then homogenized utilizing a Brinkman probe for 10 minutes at 8000 revolutions per minute resulting in a dispersion of statically bound aggregates of pigment and nonpolar olefinic resin emulsion. When a sample of the dispersion was viewed under a microscope, the aggregate sizes were observed to range from submicron to about 5 microns in diameter. The dispersion was stirred for 14 hours and then heated for 12 hours at 80 degrees centigrade, and then cooled to 5 degrees centigrade using an ice-water bath mixture. Into the cooled dispersion then bubbled chlorine gas until a pH of about 3 was obtained, and then stirring was continued for an additional 30 minutes. The composite toner particles were then repeatedly washed with warm water (60 to 70 degrees centigrade) and filtered off. The wet toner cake was then fluidized in an Aeromatic AG TM bed drier operated at 50 degrees centigrade for 3 hours. The dry composite toner particles (70 grams, 83% yield based on the weight of pigment and latex solids) were measured by a Coulter counter to have a volume average diameter particle size of 9 microns and geometric size distribution of 1.36.

EXAMPLE II

A 15 micron in situ toner comprised of Hostaperm TM Pink E-21 pigment, poly(styrene butadiene) and outer resin surface of chlorinated poly(styrene butadiene) was prepared as follows:

A one liter kettle was charged with 200 grams of the latex prepared in Example I (40 percent solid of poly(styrene-butadiene), 8 grams of a wet cake of Hostaperm TM Pink E-21 (50 percent solids in water) and the mixture homogenized using a Brinkman probe for 10 minutes 4000 revolutions per minute. To this dispersion, was then added 1 gram dialkyl benzene alkyl ammonium chloride (Alkaquat, available from Alkaril Chemical Limited) resulting in a flocculation of pigment and nonpolar emulsion resin particles. The then emulsified utilizing a Brinkman probe for 10 minutes 6000 revolutions per minute resulting in a dispersion of statically bound aggregates of pigment and nonpolar olefinic resin emulsion. When a sample of the dispersion was viewed under a microscope, the aggregate sizes were observed to range from submicron to about 7 microns in diameter. The dispersion was stirred for 14 hours and then heated for 15 hours at 85 degrees centigrade, and then cooled to 5 degrees centigrade using an ice-water bath mixture. To this was then bubbled chlorine gas until a pH of about 3 was obtained, and then stirring was continued for an additional 30 minutes. The toner particles were then repeatedly washed with warm water (60 to 70 degrees centigrade) and filtered off. The wet toner cake was then fluidized in a Aeromatic AG TM bed drier operated at 50 degrees centigrade and for a duration of 3 hours. The dry toner particles (75 grams, 89% yield based on the weight of pigment and latex solids) were then measured by a Coulter counter to have a volume average diameter particle size of 15 microns and geometric size distribution of 1.32.

EXAMPLE III

A 7 micron in situ toner comprised of Hostaperm TM Pink E-21 pigment, poly(styrene butadiene) and outer resin surface of chlorinated poly(styrene butadiene) was prepared as follows:

A one liter kettle was then charged with 200 grams of the latex prepared in Example I (40 percent solid of poly(styrene-butadiene)), 8 grams of a wet cake of Hostaperm TM Pink E-21 (50 percent solids in water) and the mixture homogenized using a Brinkman probe for a duration of 10 minutes at 4000 revolutions per minute. To this dispersion, was then added 1 gram dialkyl benzene alkyl ammonium chloride (Alkaquat, available from Alkaril Chemical Limited) resulting in flocculation of pigment and nonpolar emulsion resin particles. The flocculated material was then emulsified utilizing a Brinkman probe for 10 minutes at 8000 revolutions per minute resulting in a dispersion of statically bound aggregates of pigment and nonpolar olefinic resin emulsion particles. When a sample of the dispersion was viewed under a microscope, the aggregate sizes were observed to range from submicron to about 5 microns in diameter. The dispersion was stirred for 14 hours and then heated for 8 hours at 70 degrees centigrade, and then cooled to 5 degrees centigrade using an ice-water bath mixture. To this was then bubbled chlorine gas until a pH of about 3 was obtained, and then stirring was continued for an additional 30 minutes. The toner particles were then repeatedly washed with warm water (60 to 70 degrees centigrade) and filtered off. The wet toner cake was then fluidized in a Aeromatic AG TM bed drier operated at 50 degrees centigrade and for a duration of 3 hours. The dry toner particles (72 grams, 86% yield based on the weight of pigment and latex solids) were then measured by a Coulter counter to have a volume average diameter diameter particle size of 5 microns.

EXAMPLE IV

A 5 micron in situ toner comprised of Hostaperm TM Pink E-21 pigment, poly(styrene butadiene) and outer resin surface of chlorinated poly(styrene butadiene) was prepared as follows:

A one liter stainless steel PARR TM reactor was charged with 400 grams of water, 88 grams of styrene, 4 grams of dodecanethiol, 2 grams of polyoxyethylene nonyl phenyl ether (Antarax 897, available from Rhone-Poulenc), 2 grams of sodium dodecylsulfate and 1.5 grams of potassium persulfate. To this was then added 17 grams liquid butadiene at 5 degrees centigrade, and the mixture pressurized to about 40 pounds per square inch with nitrogen gas. The mixture was then heated to 80 degrees centigrade for 6 hours, followed by cooling to room temperature to yield a latex comprised of about 40 percent nonpolar poly(styrene-butadiene) emulsion resin. A portion of this nonpolar olefinic emulsion resin was then washed, dried and characterized as having a glass transition temperature of about 45 degrees centigrade, and a number average molecular weight of 16,000 by GPC utilizing polystyrene standards. A one liter kettle was then charged with 200 grams of the aforementioned latex (40 percent solid of poly-(styrene-butadiene), 8 grams of a wet cake of Hostaperm TM Pink E-21 (50 percent solids in water) and the mixture homogenized using a Brinkman probe for a duration of 10 minutes and at a speed of 4000 revolution per minute. To this dispersion was then added 1 gram dialkyl benzene alkyl ammonium chloride (Alkaquat, available from Alkaril Chemical Limited) resulting in flocculation of pigment and nonpolar emulsion particles. The flocculated material was then emulsified utilizing a Brinkman probe for 10 minutes at 8000 revolutions per minute resulting in a dispersion of statically bound aggregates of pigment and nonpolar olefinic version emulsion particles. When a sample of the dispersion was viewed under a microscope, the aggregate sizes were observed to range from submicron to about 5 microns in diameter. The dispersion was then heated for a duration of 12 hours at 80 degrees centigrade, and then cooled to 5 degrees centigrade using an ice-water bath mixture. To this was then bubbled chlorine gas until a pH of about 3 was obtained, and then stirring was continued for an additional 30 minutes. The toner particles were then repeatedly washed with warm water (60 to 70 degrees centigrade) and filtered. The wet toner cake was then fluidized in a Aeromatic AG TM bed drier operated at 50 degrees centigrade for 3 hours. The dry toner particles (76 grams, 91% yield) were measured by a Coulter counter to have a volume average diameter particle size of 9 microns.

EXAMPLE V

A 7.5 micron in situ toner comprised of Heliogen TM blue pigment, poly(styrene butadiene) and outer resin surface of chlorinated poly(styrene butadiene) was prepared as follows:

A mixture of 4 grams of Heliogen TM Blue pigment and one gram of dialkyl benzene alkyl ammonium chloride (Alkaquat, available from Alkaril Chemicals Limited) was sonicated for 30 minutes using a Branson 750 ultrasonicator. The resulting pigment dispersion was added to 200 grams of the aforementioned latex prepared in Example 1 (40 percent solids of poly(styrene-butadiene)) in a one liter kettle. The mixture was then homogenized using a Brinkman probe for 10 minutes at 4000 revolutions per minute. To this dispersion, was then added 1 gram dialkyl benzenealkyl ammonium chloride (Alkaquat, available from Alkaril Chemical Limited) resulting in a flocculation of pigment and nonpolar emulsion particles. The flocculated material was then homogenized utilizing a Brinkman probe for a duration of 10 minutes and at a speed of 8000 revolution per minute resulting in a dispersion of statically bounded aggregates of pigment and nonpolar olefinic emulsion. When a 1 gram sample of the dispersion was viewed under a microscope, the aggregate sizes were observed to range from submicron to about 6 microns in diameter. The dispersion was stirred for 14 hours and then heated for a duration of 10 hours at 75 degrees centigrade, and then cooled to 5 degrees centigrade using an ice-water bath mixture. To this was then bubbled chlorine gas until a pH of about 3 was obtained, and then stirring was continued for an additional 30 minutes. The toner particles were then repeatedly washed with warm water (60 to 70 degrees centigrade) and filtered off. The wet toner cake was then fluidized in a Aeromatic AG TM bed drier operated at 50 degrees centigrade and foe a duration of 3 hours. The dry toner particles (76 grams, 91% yield) were then measured by a Coulter counter to display a volume average diameter particle size of 7.5 microns and geometric size distribution of 1.53.

EXAMPLE VI

A 9.2 micron in situ toner comprised of Heliogen TM blue pigment, poly(styrene butadiene) and outer resin surface of chlorinated poly(styrene butadiene) was prepared as follows:

A mixture of 4 grams of Heliogen TM Blue pigment and one gram of dialkyl benzene alkyl ammonium chloride (Alkaquat, available from Alkaril Chemicals Limited) was sonicated for 30 minutes using a Branson 750 ultrasonicator. The resulting pigment dispersion was added to 200 grams of the aforementioned latex prepared in Example 1 (40 percent solid of poly(styrene-butadiene)) in a one liter kettle. The mixture was then homogenized using a Brinkman probe for 10 minutes at 4000 revolutions per minute. To this dispersion, was then added 1 gram dialkyl benzene alkyl ammonium chloride (Alkaquat, available from Allkaril Chemical Limited) resulting in a flocculation of pigment and nonpolar emulsion particles. The flocculents were then homogenized utilizing a Brinkman probe for a duration of 10 minutes and at a speed of 8000 revolution per minute resulting in a dispersion of statically bounded aggregates of pigment and nonpolar olefinic emulsion. When a sample of the dispersion was viewed under a microscope, the aggregate sizes were observed to range from submicron to about 6 microns in diameter. The dispersion was stirred for 14 hours and then heated for a duration of 12 hours at 80 degrees centigrade, and then cooled to 5 degrees centigrade using an ice-water bath mixture. To this was then bubbled chlorine gas until a pH of about 3 was obtained, and then stirring was continued for an additional 30 minutes. The toner particles were then repeatedly washed with warm water (60 to 70 degrees centigrade) and filtered off. The wet toner cake was then fluidized in a Aeromatic Ag TM bed drier operated at 50 degrees centigrade and foe a duration of 3 hours. The dry toner particles (70 grams, 83% yield) were then measured by a Coulter counter to display a volume average diameter particle size of 9.2 microns and geometric size distribution of 1.47.

EXAMPLE VII

A 9.5 micron in situ toner comprised of Hostaperm TM Regal 330 pigment, poly(styrene butadiene) and outer resin surface of chlorinated poly(styrene butadiene) was prepared as follows:

A one liter stainless steel PARR TM reactor was charged with 300 grams of water, 176 grams of styrene, 5 grams of dodecanethiol, 3 grams of polyoxyethylene nonyl phenyl ether (Antarax 897, available from Rhone-Poulenc), 4.5 grams of sodium dodecylsulfate and 2 grams of potassium persulfate. To this was then added 24 grams of liquid butadiene at 5 degrees centigrade, and the mixture pressurized to about 40 pounds per square inch with nitrogen gas. The mixture was then heated to 70 degrees centigrade for 8 hours, followed by cooling to room temperature to yield a latex comprised of about 40 percent by weight of solids comprised of nonpolar poly(styrene-butadiene) emulsion resin. A portion of this nonpolar olefinic emulsion resin was then washed, dried and characterized as having a glass transition temperature of about 45 degrees centigrade, and a number average molecular weight of 33,100 by GPC utilizing polystyrene standards. A one liter kettle was then charged with 200 grams of the aforementioned latex (40 percent solid of poly-(styrene-butadiene)), 8 grams of a wet cake of Hostaperm TM Pink E-21 (50 percent solids in water) and the mixture homogenized using a Brinkman probe for a duration of 10 minutes and at a speed of 4000 revolution per minute. To this dispersion, was then added 1 gram dialkyl benzene alkyl ammonium chloride (Alkaquat TM, available from Alkaril Chemical Limited) resulting in a flocculation of pigment and nonpolar emulsion resin particles. The flocculated particles were then homogenized with a Brinkman probe for a duration of 10 minutes and at a speed of 8000 revolution per minute resulting in a dispersion of statically bounded aggregates of pigment and nonpolar olefinic emulsion. When a sample of the dispersion was viewed under a microscope, the aggregate sizes were observed to range from submicron to about 5 microns in diameter. The dispersion was stirred for 14 hours and then heated for a duration of 12 hours at 80 degrees centigrade, and then cooled to 5 degrees centigrade using an ice-water bath mixture. To this was then bubbled chlorine gas until a pH of about 3 was obtained, and then stirring was continued for an additional 30 minutes. The toner particles were then repeatedly washed with warm water (60 to 70 degrees centigrade) and filtered off. The wet toner cake was then fluidized in an Aeromatic AG TM bed drier operated at 50 degrees centigrade and for a duration of 3 hours. The dry toner particles (74 grams, 88% yield) were then measured by a Coulter counter to display a volume average diameter particle size of 9.5 microns and geometric size distribution of 1.41.

Other modifications of the present invention may occur to those skilled in the art subsequent to a review of the present application, and these modifications are intended to be included within the scope of the present invention.

What is claimed is:

1. A process for the preparation of a toner composition comprising the steps of:
   (i) preparing a latex emulsion by agitating in water a mixture of a nonionic surfactant, an anionic surfactant, a first nonpolar olefinic monomer, a second nonpolar diolefinic monomer, a free radical initiator and a chain transfer agent;
   (ii) polymerizing the latex emulsion mixture by heating from ambient temperature to about 80° C. to form nonpolar olefinic emulsion resin particles of volume average diameter from about 5 nanometers to about 500 nanometers;
   (iii) diluting the nonpolar olefinic emulsion resin particle mixture with water;
   (iv) adding to the diluted resin particle mixture a colorant or pigment particles and optionally dispersing the resulting mixture with a homogenizer;
   (v) adding a cationic surfactant to flocculate the colorant or pigment particles to the surface of the emulsion resin particles;
   (vi) homogenizing the flocculated mixture at high shear to form statically bound aggregated composite particles with a volume average diameter of less than or equal to about 5 microns;
   (vii) heating the statically bound aggregate composite particles to form nonpolar toner sized particles;
   (viii) optionally halogenating the nonpolar toner sized particles to form nonpolar toner sized particles having a halopolymer resin outer surface or encapsulating shell; and
   (ix) isolating the nonpolar toner sized composite particles.

2. A process in accordance with claim 1 wherein the adding of colorant or pigment particles to the diluted particles of step (iv) is accomplished at a temperature of from about 25° C. to about 125° C.

3. A process in accordance with claim 1 wherein the optional dispersion of step (iv) is accomplished by homogenizing at from about 1000 revolution per minute to about 10,000 revolution per minute and at a temperature of from about 25° C. to about 35° C.

4. A process in accordance with claim 1 wherein the optional halogenation of step (viii) of the resin outer surface of nonpolar toner sized composite particles is accomplished with chlorine gas, liquid bromine or aqueous sodium hypochlorite at from about 5 to about 40 degrees centigrade.

5. A process in accordance with claim 1 wherein the nonpolar olefinic emulsion resin formed in step (ii) is selected from the group consisting of poly(styrene-butadiene), poly(para-methyl styrene-butadiene), poly(-meta-methyl styrene-butadiene), poly(alpha-methylstyrene-butadiene), poly(methylmethacrylate-butadiene), poly(ethylmethacrylate-butadiene), poly(propylmethacrylate-butadiene), poly(butylmethacrylate-butadiene), poly(methylcrylate-butadiene), poly(ethylacrylate-butadiene), poly(propylacrylate-butadiene), poly(-butylacrylate-butadiene), poly(styrene-isoprene), poly(-para-methyl styrene-isoprene), poly(meta-methyl styrene-isoprene), poly(alpha-methylstyrene-isoprene), poly(methylmethacrylate-isoprene), poly(ethylmethacrylate-isoprene), poly(propylmethacrylate-isoprene), poly(butylmethacrylate-isoprene), poly(methylcrylate-isoprene), poly(ethylacrylate-isoprene), poly(propylacrylate-isoprene), and poly(butylacrylate-isoprene).

6. A process in accordance with claim 1 wherein the nonpolar olefinic emulsion resin formed in step (ii) is poly(styrene-butadiene).

7. A process in accordance with claim 1 wherein the nonionic surfactant is selected from the group consisting of polyvinyl alcohol, methalose, methyl cellulose, ethyl cellulose, propyl cellulose, hydroxy ethyl cellulose, carboxy methylcellulose, polyoxyethylene cetyl ether, polyoxyethylene lauryl ether, polyoxyethylene octyl ether, polyoxyethylene octyphenyl ether, polyoxyethylene oleyl ether, polyoxyethylene sorbitan monolaurate, polyoxyethylene stearyl ether, polyoxyethylene nonylphenyl ether, and dialkylphenoxy poly(ethyleneoxy)ethanol.

8. A process in accordance with claim 1 wherein the anionic surfactant is selected from the group consisting of sodium dodecylsulfate, sodium dodecylbenzenesulfate and sodium dodecylnaphthalenesulfate.

9. A process in accordance with claim 1 wherein the cationic surfactant is a quaternary ammonium salt.

10. A process in accordance with claim 1 wherein the pigment is carbon black, magnetite, or mixtures thereof; cyan, yellow, magenta, or mixtures thereof; or red, green, blue, brown, or mixtures thereof.

11. A process in accordance with claim 1 wherein the nonpolar olefinic resin particles formed in step (ii) are from about 10 to 500 nanometers in diameter.

12. A process in accordance with claim 1 wherein the pigment particles added in step (iv) are from about 10 to 300 nanometers in volume average diameter.

13. A process in accordance with claim 1 wherein the toner particles isolated in step (ix) are from about 3 to 15 micrometers in diameter.

14. A process in accordance with claim 1 wherein the statically bound aggregate particles formed in step (iv) are from about 0.5 to about 10 micrometers in diameter.

15. A process in accordance with claim 1 wherein the nonionic surfactant concentration is about 0.1 to about 5 weight percent of the monomer content in the aqueous nonpolar olefin mixture of step (i).

16. A process in accordance with claim 1 wherein the anionic surfactant concentration is about 0.1 to about 5 weight percent of the monomer content in the aqueous nonpolar olefin mixture of step (i).

17. A process in accordance with claim 1 wherein the toner particles isolated in step (ix) have a geometric size distribution of from about 1.2 to about 1.6.

18. A process in accordance with claim 1 wherein the cationic surfactant concentration is about 0.1 to about 5 weight percent of the monomer content of the aqueous nonpolar olefin mixture of step (i).

19. A process in accordance with claim 1 wherein there is added to the surface of the isolated toner particles surface additives of metal salts, metal salts of fatty acids, silicas, or mixtures thereof, in an amount of from about 0.1 to about 10 weight percent of the toner particles.

20. A toner composition comprising composite particles comprised of pigment particles and nonpolar olefinic resin particles wherein the outer resin surface of the composite particles is a chlorinated nonpolar resin.

21. A toner composition in accordance with claim 20 wherein the toner particle size is about 3 to about 15 microns in volume average diameter.

22. A toner composition in accordance with claim 20 wherein the pigment is carbon black, magnetite, or mixtures thereof; cyan, yellow, magenta, or mixtures thereof; or red, green, blue, brown, or mixtures thereof.

23. A toner composition in accordance with claim 20 wherein the nonpolar olefinic resin is poly(styrene-butadiene) and the chlorinated nonpolar resin is poly(styrene-butadiene-dichlorobutene).

24. A toner composition in accordance with claim 20 wherein the pigment particles are from about 10 to 300 nanometers volume average diameter.

25. A toner composition in accordance with claim 20 wherein the composite particles are from about 3 to 15 micrometers in volume average diameter.

26. A toner composition in accordance with claim 20 wherein the composite particles are from about 3 to 7 micrometers in volume average diameter.

27. A toner composition in accordance with claim 20 wherein the composite particles comprised of pigment particles and nonpolar olefinic resin particles are reacted with a halogen to afford composite particles comprised of pigment particles and nonpolar olefinic resin particles wherein the outer resin surface of the composite particles is a chlorinated nonpolar resin.

28. A toner composition in accordance with claim 20 wherein the composite particles comprised of pigment particles and monpolar olefinic resin particles has a glass transition temperature of about 40° to 55° C., and wherein the chlorinated nonpolar resin on the outer surface of the composite particles has a glass transition temperature of about 55° to 65° C.

29. A toner composition in accordance with claim 20 having gloss of from about 45 to about 85 gloss units and a projection efficiency of from about 75 to about 95 percent.

30. A process in accordance with claim 1 wherein diluting the nonpolar olefinic emulsion resin particle mixture of step (iii) is accomplished with water from about 50% solids to about 15% solids; adding a colorant or pigment particles to the diluted resin particle mixture of step (iv) is accomplished with from about 3 percent to about 15 percent colorant or pigment particles by weight of resin particles and optionally dispersing the resulting mixture with a homogenizer; heating the statically bound aggregate composite particles of step(vii) is accomplished at about 60 to about 95 degrees centigrade and from about 60 minutes to about 600 minutes to form nonpolar toner sized particles of from about 3 microns to about 9 microns in volume average diameter; and isolating the nonpolar toner sized composite particles of step (ix) is accomplished by washing, filtering and drying to afford a nonpolar composite toner particle composition.

* * * * *